United States Patent [19]

Carey et al.

[11] Patent Number: 4,545,165

[45] Date of Patent: Oct. 8, 1985

[54] MODULAR MONOLITHIC CEILING GRID SYSTEM

[75] Inventors: Bruce P. Carey, Saugus; Richard M. O'Toole, Culver City, both of Calif.

[73] Assignee: Integrated Ceilings Inc., Los Angeles, Calif.

[21] Appl. No.: 523,018

[22] Filed: Aug. 15, 1983

[51] Int. Cl.[4] ..... E04C 2/42

[52] U.S. Cl. ..... 52/488; 52/484; 52/668; 403/346

[58] Field of Search ..... 52/666, 667, 668, 664, 52/665, 28, 483, 484, 488, 473, 476; 403/346, 347; 362/148, 317, 319, 354, 342

[56] References Cited

U.S. PATENT DOCUMENTS

| | | | |
|---|---|---|---|
| 3,190,208 | 6/1965 | Styne et al. | 52/664 |
| 3,355,206 | 11/1967 | Valsvik | 52/665 |
| 3,378,980 | 4/1968 | Blitzer | 52/668 |
| 3,768,224 | 10/1973 | Curtis | 52/668 |
| 4,034,534 | 7/1977 | Taylor | 403/347 |
| 4,272,804 | 6/1981 | Blum | 362/354 |

FOREIGN PATENT DOCUMENTS

| | | | |
|---|---|---|---|
| 751559 | 6/1956 | United Kingdom | 52/664 |

*Primary Examiner*—John E. Murtagh
*Assistant Examiner*—Kathryn Ford
*Attorney, Agent, or Firm*—J. E. McTaggart

[57] ABSTRACT

In a sub-ceiling system having removable modular panels of intersecting thick louvers defining a grid pattern with open cells, supported in a framework of suspended rails of inverted T cross-section, the panels are surrounded by perimeter strips attached to the ends of the louvers. The perimeter strips integrate visually with the exposed lower flange portion of the support rails to simulate louvers so as to conceal the panel boundaries and present the overall appearance of a monolithic grid pattern over the entire finished ceiling area while providing the utility and convenience of damage-resistant modular panels which are extremely easy to install and remove.

19 Claims, 3 Drawing Figures

MODULAR MONOLITHIC CEILING GRID SYSTEM

DESCRIPTION

1. Technical Field

This invention relates to the field of sub-ceiling structures in which modular panels are supported by a framework of rails suspended from the building structure overhead.

More particularly, this invention relates to such sub-ceiling structures wherein the panels display a grid pattern formed from intersecting louvers defining open cells, the louvers being of a thick or beam shape as distinguished from a thin or blade shape.

Still more particularly, this invention relates to the special category of grid panel sub-ceilings wherein the support rails and panel boundaries are visually integrated to blend unobtrusively into the louver grid patterns of the panels, presenting the appearance of a monolithic grid over the entire finished sub-ceiling area, as distinguished from the more common category of grid panel sub-ceilings wherein the support rails and panel boundaries are revealed or even accentuated architecturally.

Of critical importance for sub-ceilings within the field of this invention are the ease and economy of installing the sub-ceilings originally, the resistance of the panels to damage in handling, and the ease of removal and re-installation of the panels for cleaning, lamp replacement or access to the space above.

2. Background Art

U.S. Pat. No. 3,378,980 discloses panels with a grid pattern of intersecting louvers, supported by rails resembling the louvers, wherein some of the louver ends extend beyond the support rails, abutting, overlapping or in close proximity to corresponding shortened louver ends of adjacent panels: the support rails are made to blend with the louvers to attain the desired overall monolithic appearance. However, the exposed louver end joinings, being susceptable to bending distortion and dimensional tolerances, tend to be difficult to conceal.

U.S. Pat. No. 4,034,534 discloses panels with a grid pattern of intersecting thick louvers having a U-shaped cross section and having hooked end tabs fitting downwardly into slots in U-shaped support rails.

Both U.S. Pat. No. 3,378,980 and U.S. Pat. No. 4,034,534 are capable of providing a monolithic grid appearance; however, installation and removal of panels tend to be difficult due to the problem of aligning the numerous mating slots around the edge of the panels simultaneously; therefore structures of the type taught by these two inventions fail to provide the ease of panel installation and removal sought as an object of the present invention.

U.S. Pat. No. 3,768,224 discloses a framework of support rails having an inverted T cross-sectional shape, capable of supporting panels of various materials and textures; however, prior to the present invention, there has been no availability or knowledge of modular louvered grid panel structures capable of combination with the inverted T support rails to achieve the required overall monolithic grid appearance.

SUMMARY OF THE INVENTION

In accordance with the present invention, modular panels, formed from intersecting louvers of U-shaped cross-section defining open cells in a grid pattern, have perimeter strips attached to the ends of the louvers. The perimeter strips are dimensioned and positioned such that when the panels are set into place into a framework of inverted T support rails, such as those disclosed by U.S. Pat. No. 3,768,224, the vertical surfaces of the perimeter strips align and blend with the flanges of the support rails to simulate the appearance of the louvers; thus the desired overall monolithic appearance is accomplished along with the extreme ease of panel installation and removal provided by the inverted T support rail structure.

Subordinate features include (1) the utilization of louvers wherein the bottom of the "U" of the U-shaped louvers has a width substantially equal to the width of the cross-bar of the inverted T-shaped support bars; and (2) the perimeter strips are of L-shaped cross-section and the base of the "L" is raised relative to the bottom of the U-shaped panel louvers to make the bottom of the panels lie in the same plane as the bottom of the inverted T-shaped supports.

In accordance with a broad aspect of this invention, conventional T-bar sub-ceiling supports may be employed to produce an apparently continuous egg-crate or cross-louvered construction. This is accomplished by using thick louvers having a bottom configuration substantially the same as the bottom configuration of the T-bar supports.

In accordance with an additional aspect of the invention, the thick louvers are formed into rectangular panels, and support arrangements are provided on all four sides of each panel to rest on the T-bar supports with the lower surface of each panel preferably at the same elevation as the lower surfaces of the T-bar supports.

Further, these support arrangements may include light baffles extending upward from the outer edges of the support rails so that the T-bars with the adjacent support arrangements have substantially the same appearance as the thick louvers making up the body of each panel.

This arrangement has the advantages of both (1) an apparently infinite continuous sub-ceiling; while also (2) providing the ease of quick panel removal for access to lights or other structure located above the sub-ceiling.

Other objects, features and advantages of the invention will become apparent from a consideration of the following detailed description, and the accompanying drawings.

BRIEF DESCRIPTION OF THE DRAWINGS

The details of this invention will be described in connection with the accompanying drawings, in which.

DETAILED DESCRIPTION

Figure 1:
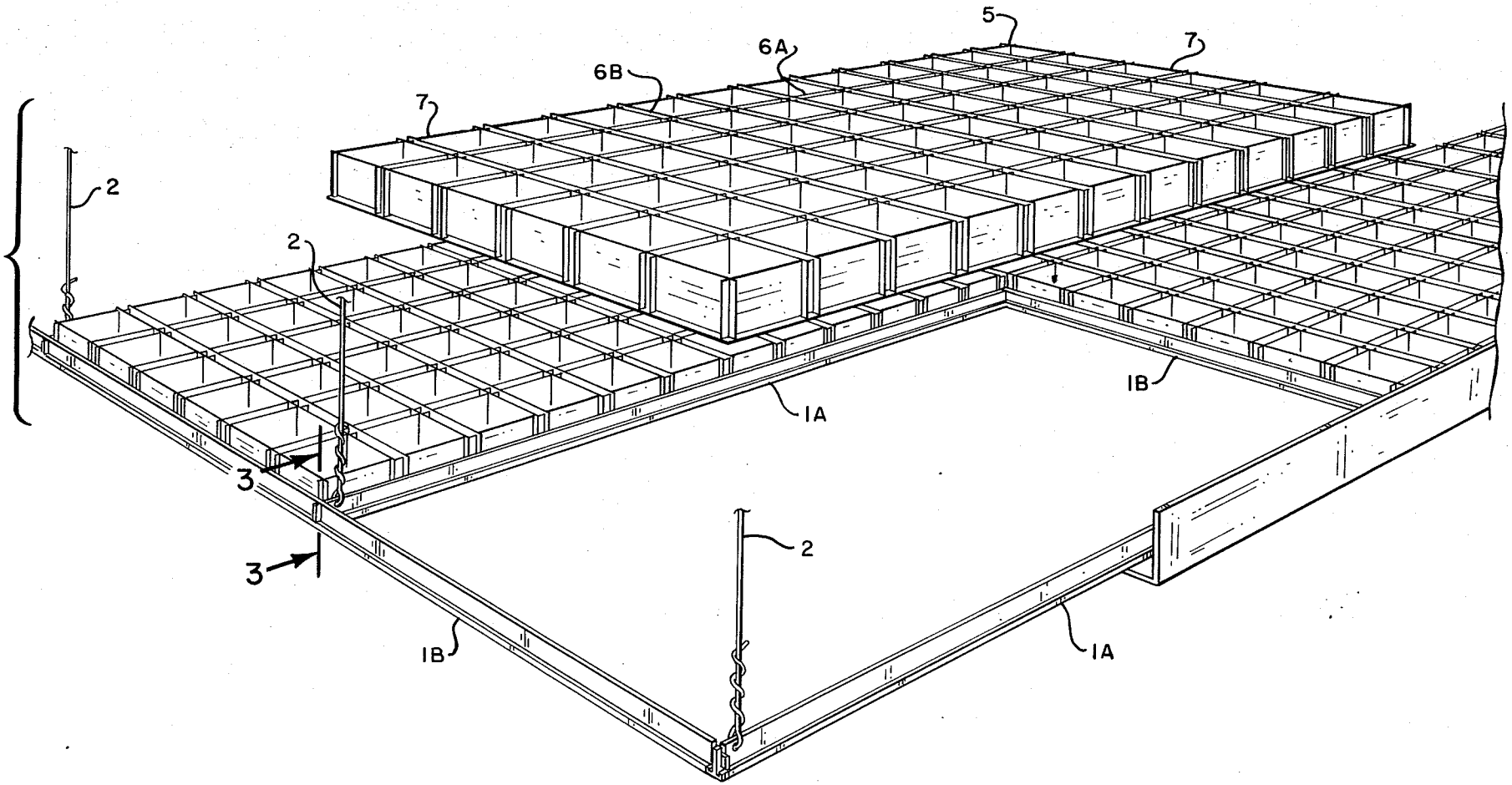
FIG. 1 is a perspective view of a sub-ceiling illustrating the principles of the invention, having one of the modular panels removed.

Referring to the drawings, FIG. 1 shows a sub-ceiling constructed according to this invention, having a framework of latitudinal support rails lA and longitudinal support rails lB, suspended from the structure of a building by wire hangers 2. The support rails have an inverted T cross-sectional shape as shown in FIG. 2 and FIG. 3, with flanges 3 at the bottom as shown, including optional upturned rims 4 at the outer edges of the flanges.

Incidentally, for convenience in the present description, the adjectives "latitudinal" and "longitudinal" are employed to designate substantially perpendicular sets of rails or louvers.

Modular panels, typified by panel 5, shown removed in FIG. 1, are set into place from above into rectangular cell openings provided by the intersecting support rails 1. Each panel 5 comprises intersecting latitudinal louvers 6A and longitudinal louvers 6B, having a U-shaped cross-section as shown in FIG. 2. The louver ends are assembled to perimeter strips 7 which have an L-shaped cross-section with the foot portion resting on top of the flange rims 4 of the support rails 1, as shown in FIG. 3. It will be noted that the outer edges of the flanges of support rails 1 are in alignment with the vertical surfaces of the perimeter strips 7, and the bottom surfaces of the louvers 6 are co-planar with the bottom surfaces of the support rail flanges 3. The width of the flanges 3 is made equal to the thickness of the louvers 6, thus the exposed portions of the support rail flanges 3 and the perimeter strips 7 blend to simulate the appearance of the louvers 6 to disguise the support rails 1 by integrating them into the required overall monolithic grid ceiling appearance.

Figure 2:
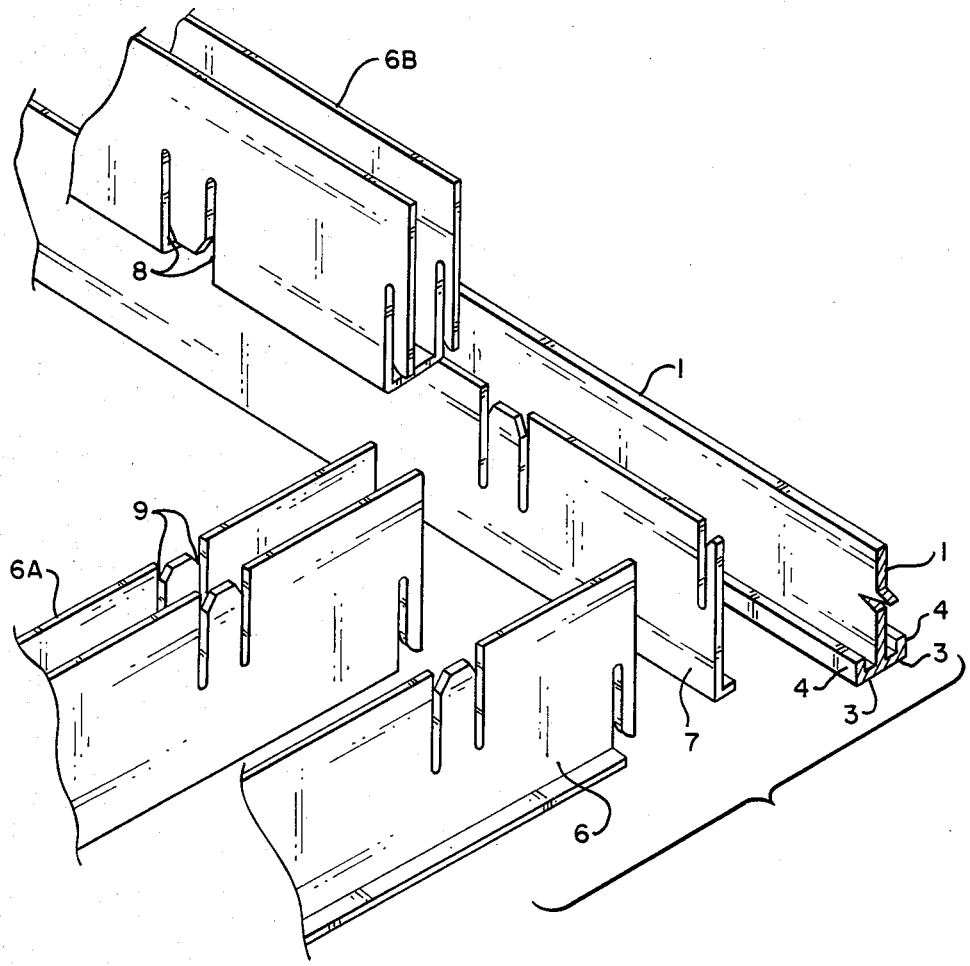
FIG. 2 perspective view showing the louvers and perimeter strips of a corner portion of a panel prior to assembly.
Figure 3:
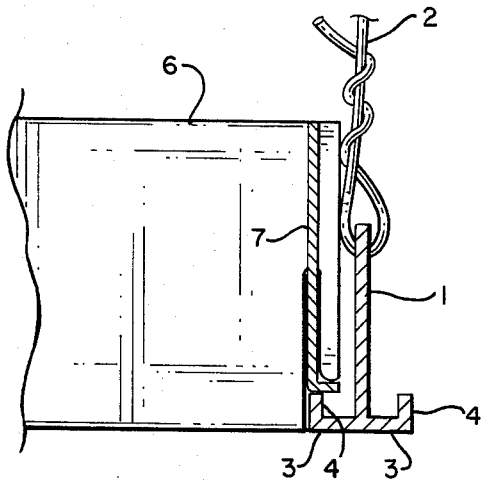
FIG. 3 is a cross-sectional view of an inverted T rail, supporting L-shaped perimeter strips at the ends of U-shaped louvers forming the modular panel.

The intersections of latitudinal louvers 6A with longitudinal louvers 6B and the fastening of the louvers 6 to the perimeter strips 7 are accomplished through the use of mating half-slots as shown in FIG. 2. It may be noted that the bottom of the "U" must be cut away to form the half-slot construction 8 which mates with the simpler pair of half slots 9 as shown in FIG. 2. Once the panels 5 are assembled, there is never any need to dissemble any of the slot joinings afterwards, therefore the slots may be dimensioned to fit each other tightly to avoid rattles and light leaks. In systems which depend on half-height slots to carry the panels on the support rails, a compromise is required between a loose fit to permit panel removal and a tight fit to avoid rattles and light leaks.

In the preferred embodiment of this invention, the support rails are spaced 24" by 48" on centers, a common standard size facilitating the optional installation of standard size fluorescent lighting troffers and other modular ceiling utilities. For mounting smaller light troffers or other appliances into a louvered panel, holes may be provided in the louvers at concealed locations within the intersections to accomodate wire hangers for additional support.

In the preferred embodiment of this invention, the louvers are spaced 4" on centers, the support rail flange width and the louver thickness are ½", and the louvers are 2⅛ high. The louvers are formed from sheet aluminum, approximately 0.024" thick. The rims 4, flanges 3, and the web of the support rails 1 are made approximately 1/16" thick in the preferred embodiment of this invention, where the support rails are extruded from aluminum. Alternatively, the rails may be roll-formed from sheet steel or aluminum, and may be formed with an enlarged tubular shape along the upper edge of the rail for stiffening. The shape and dimensions of the web portion of the support rails may be modified as desired for strucural purposes without affecting the monolithic appearance of the ceiling, since that portion of the rails is concealed by the panel perimeter strips 7.

In the preferred embodiment of this invention, the exposed lower flange portion of the support rails is finished or painted to match the finish or paint on the louvers of the panels. Alternatively, the support rail flanges may be designed to be enclosed by a metal wrap-around cap, suitably finished or painted.

The height of the support rail outer flange edges is made 3/16" in the preferred embodiment: this dimension may be modified at the designer's discretion, or the flange rim 4 may be omitted to use a plain flange such as is disclosed in U.S. Pat. No. 3,768,224.

The position of the perimeter strips 7 with respect to the louver ends in co-operation with the height of the outer edges of the support rail flanges aligns the lower surfaces of the support rails 1 in coplanar relationship with the lower surfaces of the louvers 6.

The principles taught by this invention are applicable to numerous variations in addition to the completely monolithic ceiling grid pattern disclosed: architecturally desirable patterns may be created by concealing some of the support rails as described while allowing other support rails to be revealed or accentuated. For example, in a structure like that shown in FIG. 1, the longitudinal rails 1A, spaced 24" on centers, may be concealed by locating their bottom surfaces at the same elevation as the louver bottoms, while accentuating the latitudinal rails 1B, spaced 48" on centers, by extending their bottom surfaces further downward to a lower elevation than the other rail and louver bottoms. The effect thus created is that of 48" wide monolithic grid panels running the full length or width of a room, demarked by the prominent latitudinal rails lB which may be finished distinctively to provide further contrast. As in the preferred embodiment, this configuration also readily accepts standard sized lighting troffers and other ceiling utilities in the standard 24" by 48" support rail openings.

This invention is susceptable of many variations in dimensions and proportions, and may be fabricated from a variety of materials by those skilled in the art, without departing from the intent and spirit of the invention. In addition to the alternatives mentioned in the preceeding paragraph, instead of using L-shaped perimeter strips, the ends of the U-shaped thick louvers may be partially cut vertically, and bent into a horizontal plane to rest on the T-bar supports with the bottom of the louvers co-planar with the bottom of the T-bar supports. The present invention encompasses all such variations and alternatives.

What is claimed is:

1. A suspended sub-ceiling structure comprising a suspended lattice framework of intersecting support rails, each rail having a vertical web part and a horizontal flange part extending outwardly in both directions at the lower edge of the web, forming an inverted T cross-section, a plurality of rectangular modular panels removably disposed within openings defined by said support rails, one panel to each opening, each panel being formed from intersecting louvers defining rectangular cell openings, each louver having a U-shaped cross-section, the thickness of the louvers being substantially equal to the width of the support 15 rail flanges, a plurality of perimeter strips, one along each of the four sides of each of said panels, means for attaching said perimeter strips to the ends of the louvers, means integral with said perimeter strips for supporting said panels upon the upper surfaces of the support rail flange parts, with the lower surfaces of the louvers coplanar with the lower surfaces of the support rails and the exposed vertical surfaces of said perimeter strips aligned vertically with the outer edges of the support rail flange parts, whereby the exposed surfaces of the perimeter strips and the support rail flange parts are made to blend, simulating the appearance of the louvers, thus causing the overall ceiling to present the appearance of a monolithic louvered open cell grid pattern in which said modular panels are visually integrated, substantially concealing the panel outlines.

2. The invention as defined in claim 1 wherein said means for attaching said perimeter strips to the ends of the louvers comprises louver end extension tabs on each side of said louver end, defining downward-facing slots mated with upward-facing slots in said perimeter strips.

3. The invention as defined in claim 1 wherein said perimeter strips are made to have an L-shaped cross-section comprising a vertical portion and a horizontal foot portion, said perimeter strips being assembled to said panels with the horizontal foot portions extending outwardly from said panels, and wherein said means for supporting said panels on the support rails comprises the horizontal foot portion of said perimeter strips.

4. The invention as defined in claim 1 wherein said support rails are extruded from aluminum.

5. The invention as defined in claim 1 wherein said support rails are roll-formed from sheet metal.

6. The invention as defined in claim 1 wherein said louvers are formed from sheet metal.

7. The invention as defined in claim 1 wherein each said louver is substantially flat on its bottom and two sides.

8. A suspended sub-ceiling structure comprising a suspended lattice framework of intersecting support rails, each rail having a vertical web part and a flange extending outward horizontally in both directions at the lower edge of the web;

a plurality of rectangular modular panels, each formed from intersecting louvers defining rectangular cell openings, the thickness of the louvers at their lower edges being substantially equal to the width of the support rail flanges; and said panels including support means located along each of the four sides of each of said panels, at the ends of the louvers;

said structure including means for mounting said panels with said support means resting on the upper surfaces of the support rail flanges, and the lower surfaces of the louvers being substantially coplanar with the lower surfaces of the support rails;

whereby the overall ceiling appearance is made to present the effect of a monolithic louvered open cell grid pattern wherein the boundary outlines of said modular panels are substantially concealed.

9. The invention as defined in claim 8 wherein said louvers are sheet metal formed to have a U-shaped cross-section.

10. The invention as defined in claim 9 wherein each said louver has a configuration at the bottom of the "U" substantially the same as the bottom of said support rails.

11. The invention as defined in claim 10 wherein each said louver is substantially flat on its bottom and two sides.

12. The invention as defined in claim 9 wherein said support rails are extruded aluminum.

13. The invention as defined in claim 8 wherein said support rails are roll-formed steel.

14. The invention as defined in claim 8 wherein said support means comprises a plurality of perimeter strips, one along each of the four sides of each of said panels, said perimeter strips having an L-shaped cross-section with the foot of the L facing outwardly from the body of the panel, resting on the upper surfaces of the support rail flanges.

15. In a suspended subceiling of removable modular panels formed from intersecting thick vertical louvers defining an open cell grid pattern, supported by a framework of intersecting rails, complementary panel edge and rail structure along at least one boundary between adjacent panels, for integrating the grid patterns of the individual adjacent panels into a combined monolithic grid pattern in which the boundary is concealed and the support rail is disguised as part of a louver, said structure comprising;

a support rail, interposed between said adjacent panels, having a bottom flange part extending horizontally outward in both directions, whereby the rail is made to have a cross-sectional shape approximating an inverted letter "T", the width of said flange being substantially equal to the thickness of said louvers, baffle means attached to the ends of the louvers of each of said adjacent panels along their adjacent edges, said baffle means resting on the upper surfaces of said support rail flanges, and said baffle means having vertical surfaces located coplanar with the outer edges of said flanges, whereby the combined appearance of said support rail flange and said baffle means is made to resemble the shape and appearance of said louvers, thus integrating said adjacent panels into a combined monolithic grid pattern wherein the boundary is concealed and the rail is disguised as part of a louver.

16. The invention as defined in claim 15 wherein said baffle means comprise perimeter strips, one along each adjacent edge of said adjacent panels, and means for attaching said perimeter strips to the ends of the louvers, said perimeter strips having a cross-section shaped like the letter "L" with a vertical part and a horizontal foot part extending outwardly away from the body of its host panel.

17. The invention as defined in claim 16 wherein said perimeter strip foot part, resting on the upper surface of the support rail flange, positions the lower surfaces of the louvers at the same elevation as the lower surfaces of the support rails.

18. The invention as defined in claim 17 wherein said louvers are of sheet metal, formed to have a U-shaped cross-section, and wherein each of said louvers has a configuration at the bottom of the "U" substantially the same as the bottom of said support rails.

19. The invention as defined in claim 18 wherein each said louver is substantially flat on its bottom and two sides.

* * * * *